US007334890B2

(12) United States Patent
Nakamura

(10) Patent No.: US 7,334,890 B2
(45) Date of Patent: Feb. 26, 2008

(54) RECORDING APPARATUS

(75) Inventor: Nobuyuki Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 328 days.

(21) Appl. No.: 10/540,018

(22) PCT Filed: Dec. 22, 2003

(86) PCT No.: PCT/JP03/18432

§ 371 (c)(1),
(2), (4) Date: Jun. 22, 2005

(87) PCT Pub. No.: WO2004/058614

PCT Pub. Date: Jul. 15, 2004

(65) Prior Publication Data

US 2006/0250468 A1 Nov. 9, 2006

(30) Foreign Application Priority Data

Dec. 24, 2002 (JP) ..... 2002-372703

(51) Int. Cl.
*B41J 2/01* (2006.01)

(52) U.S. Cl. ..... 347/104; 347/101; 400/636.3; 400/637.3; 400/639

(58) Field of Classification Search ..... 347/104, 347/101; 400/636, 636.3, 637, 637.3, 639, 400/637.1, 641
See application file for complete search history.

(56) References Cited

U.S. PATENT DOCUMENTS

| | | | | |
|---|---|---|---|---|
| 5,602,571 A | | 2/1997 | Suda et al. | |
| 5,742,318 A | * | 4/1998 | Miyauchi et al. | 347/134 |
| 5,874,979 A | * | 2/1999 | Ohyama | 347/104 |
| 6,293,669 B1 | * | 9/2001 | Uchida | 347/104 |
| 6,712,463 B2 | * | 3/2004 | Matsumoto | 347/104 |
| 2002/0171727 A1 | * | 11/2002 | Kida et al. | 347/104 |

FOREIGN PATENT DOCUMENTS

| | | | |
|---|---|---|---|
| EP | 818 320 A2 | | 1/1998 |
| JP | 7061072 | * | 3/1995 |
| JP | 8-208094 A | | 8/1996 |
| JP | 8208094 | * | 8/1996 |
| JP | 10-26851 A | | 1/1998 |
| JP | 2000318898 | * | 11/2000 |
| JP | 2002-178583 A | | 6/2002 |
| JP | 20020179319 | * | 6/2002 |
| JP | 2002-332137 A | | 11/2002 |
| JP | 2002326755 | * | 11/2002 |
| JP | 2004196537 | * | 7/2004 |

* cited by examiner

*Primary Examiner*—Matthew Luu
*Assistant Examiner*—Joshua M Dubnow
(74) *Attorney, Agent, or Firm*—Birch, Stewart, Kolasch & Birch, LLP

(57) ABSTRACT

In second transport means (12), nipping pressure of each of outermost star wheels (6*a*), (6*e*) located at opposite ends in the primary scanning direction is set higher than that of each of star wheels (6*b*) to (6*d*) within a range lower than nipping pressure of first transport means. If a leading edge of a recording medium (1) is in a downwardly deformed state when reaching the second transport means (12), such deformation acts to press the wheels (6*a*) to (6*e*) upwardly. However, the nipping pressure of each of the opposite end star wheels (6*a*), (6*e*) nipping angular portions of the medium (1) on the leading edge side is set high enough to rectify such deformation at the angular portions. Accordingly, the medium (1) is nipped between a second driving roller (5) and the wheels (6*a*) to (6*e*) with its deformed angular portions rectified, and hence is transported in an ideal condition.

8 Claims, 5 Drawing Sheets

RECORDING APPARATUS

TECHNICAL FIELD

The present invention relates to recording apparatuses of the type configured to jet ink against a recording medium being transported, such as ink jet printers, and more particularly to such a recording apparatus capable of transporting recording media properly.

BACKGROUND ART

FIG. 1 schematically illustrates the recording medium transport mechanism of a conventional ink jet printer. The conventional ink jet printer includes a first driving roller (which, together with a first driven roller 4, constitutes first transport means) 3 located upstream of a carriage unit 2 having an ink head 7 in a direction in which recording medium 1 is transported and is configured to transport recording medium 1 such as a recording sheet to a location just below an ink jet nozzle 7 of the carriage unit 2 where recording medium 1 is to be temporarily halted, and then move the carriage unit 2 in a direction (primary scanning direction) perpendicular to the recording medium 1 transport direction for printing on the recording medium 1. Thereafter, the ink jet printer advances the recording medium 1 by means of the first driving roller 3 again so that a portion of the recording medium 1 to be subjected to printing next is located just below the ink head 7 and then moves the carriage unit 2 during temporary stop of recording medium 1 for printing. These operations are repeated to form an image on whole one side of recording medium 1.

In order to increase the printing speed of such a recording apparatus without varying the speed of movement of the carriage unit 2 and the recording medium transport speed, the recording medium 1 is moved by the maximum printable width of the ink head 7 for each advance thereof. Thus, the movement of the carriage unit 2 and the advance of the recording medium 1 are repeated. If moving ranges of the ink head 7 are made to overlap each other with the amount of each advance of the recording medium 1 reduced, inks can be jetted onto the same portion of the recording medium 1 in an ink-on-ink manner thereby printing an image of higher definition.

On the downstream side of the carriage unit 2 is disposed a second transport means for transporting and ejecting the recording medium 1, the second transport means comprising a second driving roller 5 to which a rotational force is transmitted, and a star wheel 6 which is driven to rotate while nipping the recording medium 1 between itself and the second driving roller 5. The star wheel 6 forming part of the second transport means has sharp teeth circumferentially thereof and is supported so as to be capable of coming into contact with and separating from the periphery of the second driving roller 5 by means of a non-illustrated spring member. The star wheel 6 biases the recording medium 1 toward the second driving roller 5 by the elastic force of the spring member (see Japanese Patent Laid-Open Publication No. H08-208094 for example.)

However, in the ink jet printer configured to repeat a sequence of advancing and temporarily halting the recording medium 1 and moving the carriage unit 2, it is possible that the recording medium 1 stops being transported when the leading edge of recording medium 1 reaches a location just past the nipping position between the second driving roller 5 and the star wheel 6, i.e., the position where the recording medium 1 receives the transporting force from the second driving roller 5. In this case, since the star wheel 6 is supported so as to be capable of coming into contact with and separating from the periphery of the second driving roller 5, it is possible that the second driving roller 5 and the star wheel 6 fail to ideally catch the recording medium 1 therebetween when the leading edge of the recording medium 1 is not in a good condition. For this reason, the second driving roller 5 and the star wheel 6 cannot reliably transport the recording medium 1, thus raising a problem of unstable transport of recording medium 1.

For example, when the leading edge of recording medium 1 is deformed downwardly as shown in FIG. 2, the leading edge is brought into contact with the second driving roller 5 first and then raised as kept deformed downwardly as the second driving roller 5 rotates, thereby pressing the star wheel 6 upwardly away from the second driving roller 5. When the star wheel 6 becomes separated from the second driving roller 5, the star wheel 6 cannot rotate because the star wheel 6 does not directly receive the rotational force but is driven to rotate by the second driving roller 5. In such a case the star wheel 6 becomes an obstacle to transport of the recording medium 1. Thus, it becomes possible for the star wheel 6 to facilitate deformation of recording medium 1 or damage the recording medium 1 and, in the worst case, to cause jam to occur.

To avoid such a phenomenon, it is conceivable that the star wheel 6 is configured to apply the recording medium 1 with sufficient pressure to rectify the deformed condition of the leading edge of recording medium 1 to an ideal condition. However, if the second driving roller 5 is pressurized excessively by the star wheel 6, large load fluctuations occur when the recording medium 1 advances to the contact position between the second driving roller 5 and the star wheel 6, so that smooth transport of the recording medium 1 is impeded on the contrary. Also, since the periphery of the star wheel 6 comprises a multiplicity of sharp teeth, application of excessive pressure to the recording medium 1 by the star wheel 6 will result in a problem of damage to the surface of recording medium 1.

Such problems are common to recording apparatuses of the type having transport means comprising a roller pair including a star wheel as a driven roller, as well as to ink jet printers.

An object of the present invention is to provide a recording apparatus which is capable of reliably nipping a recording medium by second transport means including a star wheel without the need to apply excessive pressure onto the recording medium from the star wheel even when a leading edge portion of the recording medium has some deformation, thereby constantly ensuring smooth and stable transport of the recording medium.

DISCLOSURE OF THE INVENTION

The present invention provides the following arrangements as means for solving the aforementioned problems.

(1) A recording apparatus wherein: a recording medium is transported by first and second transport means nipping the recording medium; and the second transport means comprising plural roller pairs arranged in a direction perpendicular to a recording medium transport direction and is disposed downstream of the first transport means in the recording medium transport direction, characterized in that each of the roller pairs of the second transport means is set to have a lower nipping pressure than the first transport means, while an outermost one of the roller pairs set to have a higher nipping pressure than the rest of the roller pairs.

In this arrangement, the second transport means comprising the plural roller pairs arranged in the direction perpendicular to the recording medium transport direction is disposed downstream of the first transport means, and each of the roller pairs of the second transport means is set to have a lower nipping pressure than the first transport means, while the outermost one of the roller pairs set to have a higher nipping pressure than the rest of the roller pairs.

Deformation of the recording medium occurs frequently at angular portions of the recording medium. Though jam is most likely when such deformation occurs, rectification of the deformation at the angular portions allows deformation at a central portion of the recording medium to be rectified relatively easily following the rectification of the deformation at the angular portions. Thus, it becomes possible to transport the recording medium in an ideal condition. Also, because the angular portions of the recording medium are not constrained on one side in the direction perpendicular to the recording medium transport direction, the deformation at the angular portions can be rectified with a weaker external force than is required to rectify the deformation at the central portion.

Thus, with the arrangement wherein only the opposite outermost ones of the plural roller pairs arranged in the direction perpendicular to the recording medium transport direction, which are adapted to contact portions of the recording medium adjacent to the angular portions, are each set to have a nipping pressure which is increased by a necessary and sufficient value for rectification of the deformation at the angular portions of the recording medium within a range that is lower than the nipping pressure of the first transport means, while the rest of the plural roller pairs, including a centrally positioned roller pair, is set to have a lower nipping pressure than the opposite outermost roller pairs, there is no possibility that the recording medium is applied with an excessive nipping pressure and the sum total of the nipping pressures of the plural roller pairs forming the second transport means increases considerably. Thus, there is no possibility that the surface of the recording medium is damaged and large load fluctuations occur upon entry of the recording medium into the second transport means. Accordingly, this arrangement can assuredly rectify the deformation at the angular portions of the recording medium without any impediment to smooth transport of the recording medium.

(2) The plural roller pairs of the second transport means are disposed to have plural nipping positions in the recording medium transport direction such that the outermost one of the plural roller pairs is different in nipping position from the rest of the plural roller pairs.

In this arrangement, the outermost one of the plural roller pairs forming the second transport means, which is set to have a higher nipping pressure than the rest of the plural roller pairs, is disposed so as not to have a nipping position coinciding with that of the rest in the recording medium transport direction. Accordingly, the relatively high nipping pressure of the outermost roller pair and the nipping pressure of the rest are not exerted on the leading edge portion of the recording medium being transported at a time. Thus, there is no possibility that large load fluctuations occur upon entry of the recording medium into the second transport means. For this reason, this arrangement can assuredly rectify the deformation at the angular portions of the recording medium without any impediment to smooth transport of the recording medium.

(3) The plural roller pairs of the second transport means are disposed to have plural nipping positions in the recording medium transport direction such that a central one of the plural roller pairs has a nipping position located most upstream.

In this arrangement, the central one of the plural roller pairs forming the second transport means, which has a lower nipping pressure than the opposite end roller pairs, has a nipping position located most upstream in the recording medium transport direction. Accordingly, the relatively low nipping pressure is initially exerted centrally of the leading edge portion of the recording medium having reached the second transport means. Thus, there is no possibility that large load fluctuations occur upon entry of the recording medium into the second transport means. For this reason, this arrangement can assuredly rectify deformation at the angular portions of the recording medium without any impediment to smooth transport of the recording medium.

(4) The plural roller pairs of the second transport means are disposed to have plural nipping positions in the recording medium transport direction such that any one of the roller pairs which is located immediately downstream of an upstream one of the roller pairs in the recording medium transport direction has a higher nipping pressure than the upstream one.

In this arrangement, the plural roller pairs forming the second transport means are disposed to have plural nipping positions in the recording medium transport direction such that any one of the roller pairs which is located immediately downstream of an upstream one of the roller pairs in the recording medium transport direction has a higher nipping pressure than the upstream one. Accordingly, gradually increasing nipping pressure is exerted on the leading edge portion of the recording medium being transported and, hence, there is no possibility that a high nipping force is abruptly exerted on the leading edge portion. Thus, there is no possibility that large load fluctuations occur upon entry of the recording medium into the second transport means. For this reason, this arrangement can assuredly rectify deformation at the angular portions of the recording medium without any impediment to smooth transport of the recording medium.

(5) The second transport means is configured to transport the recording medium at a higher speed than the first transport means.

In this arrangement, the recording medium transport speed of the second transport means is higher than that of the first transport means located upstream of the second transport means. Accordingly, a larger transporting force is exerted on the recording medium on the downstream side than on the upstream side in the transport direction and, hence, there is no possibility that the recording medium becomes deflected between the first and second transport means. Also, tension working in the transport direction is exerted on the recording medium being transported, so that deformation of the recording medium is rectified more effectively.

(6) A plurality of such second transport means are arranged in the recording medium transport direction.

In this arrangement, the plurality of second transport means are arranged downstream of the first transport means in the recording medium transport direction. Accordingly, the recording medium being transported is kept nipped at two points in the transport direction during a period just after passage of the trailing edge thereof through the first transport means until arrival thereof at the second transport means. Thus, even when the recording medium is deformed at angular portions on the trailing edge side thereof, this arrangement can rectify such deformation by means of the roller pairs located at opposite ends in the direction perpendicular to the transport direction while keeping the surface of the recording medium parallel with the transport direction, whereby smooth transport can continue until the trailing edge of the recording medium passes through the second transport means.

(7) Each of the roller pairs forming the second transport means comprises a driving roller receiving a rotational force transmitted thereto, and a star wheel driven to rotate the driving roller rotating.

In this arrangement, the second transport means located downstream of the first transport means includes the plural roller pairs arranged in the direction perpendicular to the transport direction, each of the plural roller pairs comprising the driving roller receiving a rotational force transmitted thereto, and the star wheel driven to rotate by the driving roller rotating. Accordingly, the roller pairs forming the second transport means can be made different in nipping pressure from each other easily by adjusting the force of pressing the star wheel against the driving roller. Even when the roller pairs of the second transport means are made to have different nipping pressures within a range that is lower than the nipping pressure of the first transport means, such different nipping pressures will not influence over a large area of the surface of the recording medium.

(8) A carriage unit having an ink head configured to jet ink against the recording medium is disposed between the first and second transport means arranged in the recording medium transport direction to reciprocate in the direction perpendicular to the recording medium transport direction.

In this arrangement, the first transport means and the second transport means are arranged across the position of the carriage unit from upstream to downstream in the recording medium transport direction. Accordingly, the recording medium having been transported to the position of the carriage unit as the printing position by the first transport means and then printed with an image during passage through the printing position can be transported smoothly with deformation at angular portions thereof rectified by the roller pairs disposed at opposite ends in the direction perpendicular to the transport direction during its passage through the second transport means.

BEST MODE FOR CARRYING OUT THE INVENTION

Figure 1:
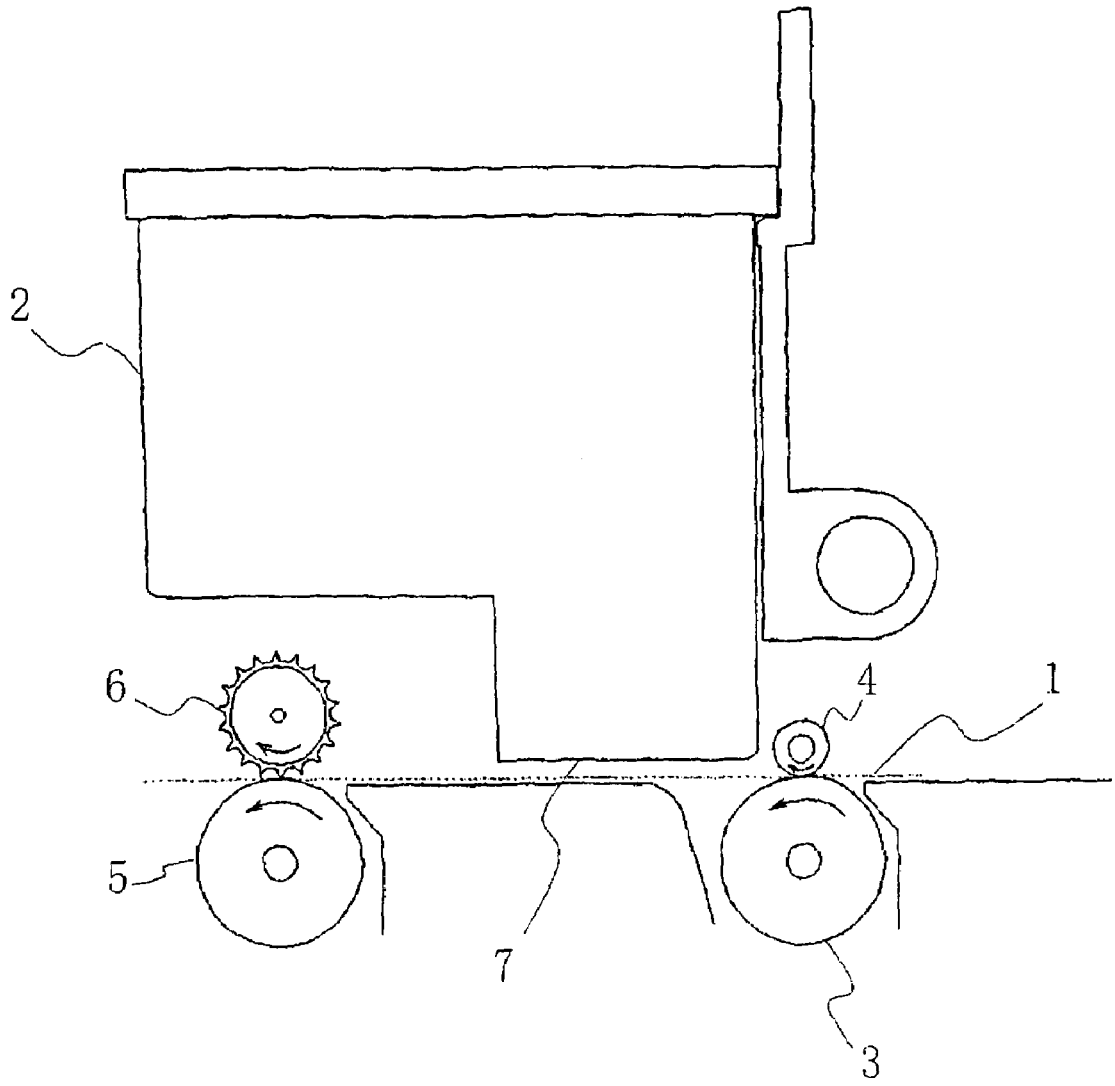
FIG. 1 Conventional Art
FIG. 1 is a side elevational view showing a portion of concern of a conventional recording apparatus.
Figure 2:
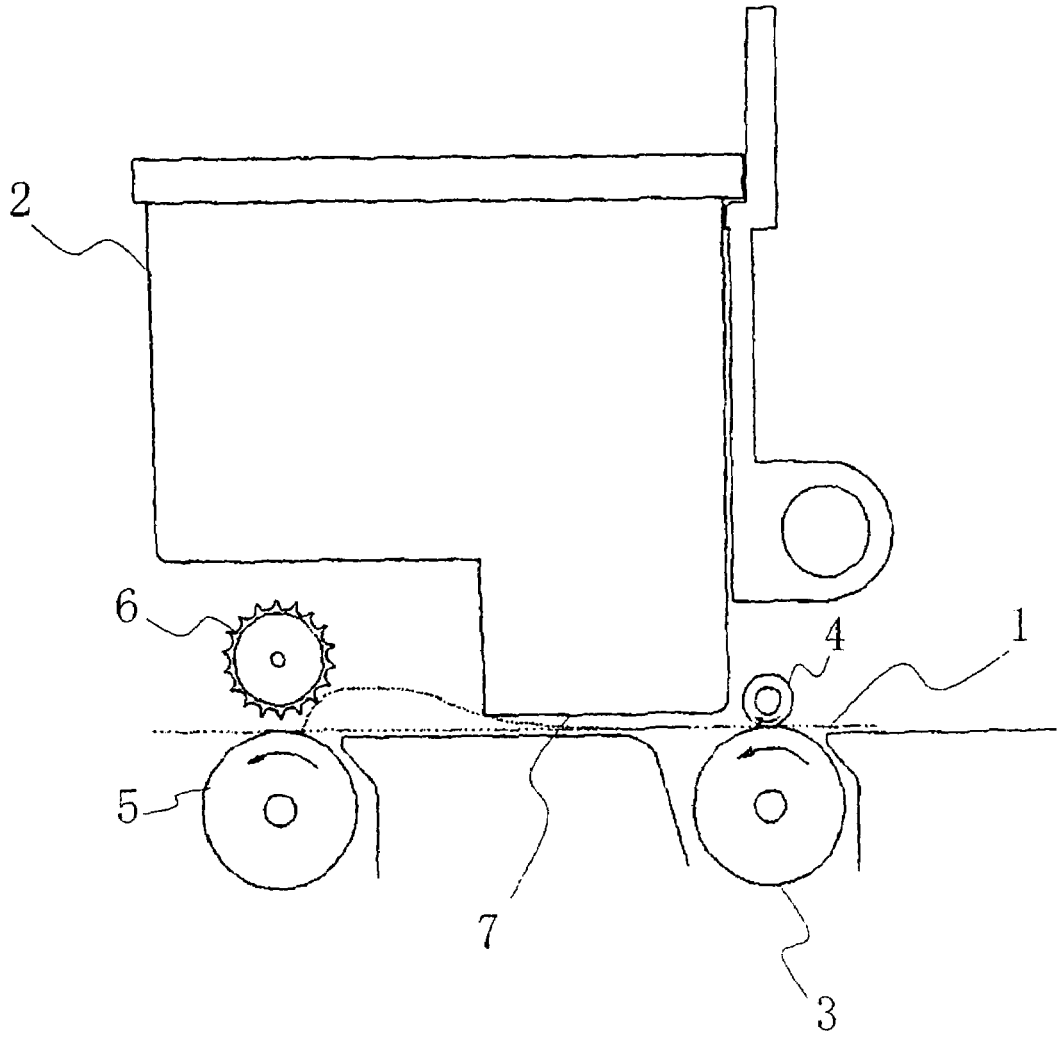
FIG. 2 Conventional Art
FIG. 2 is a side elevational view illustrating a state where a deformed recording medium is transported in another conventional recording apparatus.
Figure 3A:
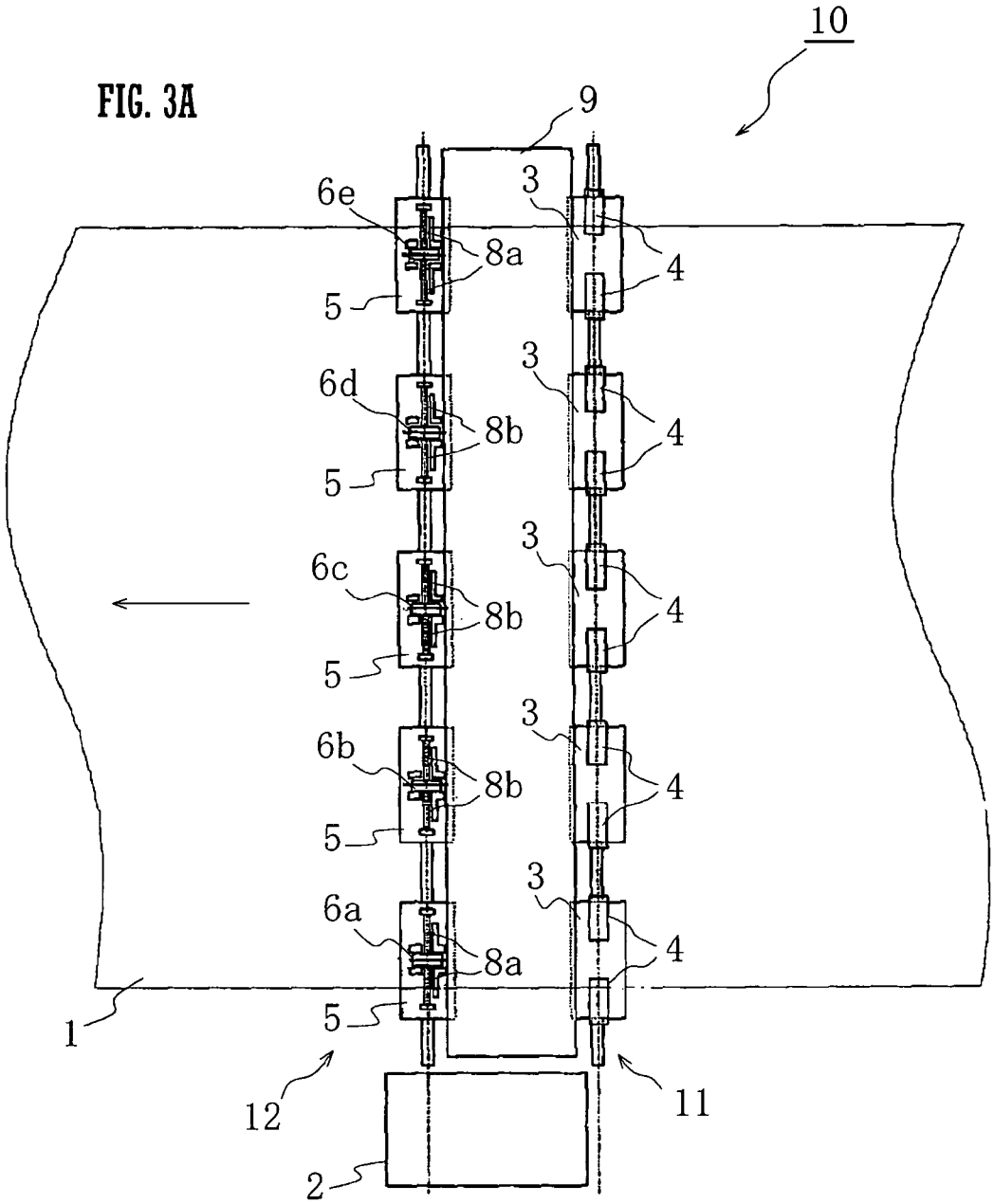
FIGS. 3A and 3B are a plan view and a side elevational view, respectively, showing a portion of concern of an ink jet printer as one example of recording apparatus according to an embodiment of the present invention.
Figure 3B:
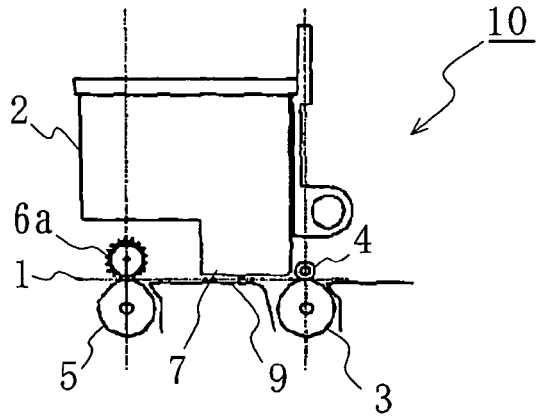

FIGS. 3A and 3B are a plan view and a side elevational view, respectively, showing a portion of concern of an ink jet printer as one example of recording apparatus according to an embodiment of the present invention. In ink jet printer 10 of this embodiment, first transport means 11 and second transport means 12 are arranged across the printing position where a carriage unit 2 and a platen 9 are located in this order from upstream to downstream in a direction in which a recording medium 1 is to be transported, as in the arrangement shown in FIG. 1.

The carriage unit 2 is mounted on a cartridge having an ink head 7 configured to jet ink. The carriage unit 2 is guided along a non-illustrated guide shaft to reciprocate in the primary scanning direction perpendicular to the recording medium 1 transport direction by driving force transmitted thereto via a non-illustrated timing belt. During reciprocation the ink head 7 is fed with driving signals based on video signals through a non-illustrated flat cable or the like. Thus, the carriage unit 2 jets ink from the ink head 7 against the surface of recording medium 1 supported on the platen 9 to print an image while reciprocating in the primary scanning direction.

The first transport means 11 includes plural roller pairs arranged in the direction perpendicular to the recording medium 1 transport direction, the plural roller pairs each comprising a first driving roller 3 to which rotation is transmitted from a non-illustrated driver such as a motor, and a first driven roller 4 to be driven to rotate by the first driving roller 3 rotating. The first transport means 11 transports recording medium 1 to the printing position where the ink head 7 of the carriage unit 2 faces the platen 9 while nipping the recording medium 1 between the first driving roller 3 and the first driven roller 4. The first driven roller 4 is pressed against the first driving roller 3 at a predetermined pressing force, whereby the first transport means 11 exerts on the recording medium 1 a predetermined nipping pressure sufficient to transport recording medium 1.

The second transport means 12 includes plural roller pairs arranged in the direction perpendicular to the recording medium 1 transport direction, the plural roller pairs each comprising a second driving roller 5 to which rotation is transmitted from a non-illustrated driver such as a motor, and star wheels 6*a* to 6*e* as a second driven roller 4 to be driven to rotate by the second driving roller 5 rotating. The second transport means 12 transports recording medium 1 having passed through the printing position to a delivery section fitted with a non-illustrated ejected sheet tray while nipping recording medium 1 between the second driving roller 5 and the star wheels 6*a* to 6*e*. The star wheels 6*a* to 6*e* are pressed against the second driving roller 5 at a predetermined pressing force, whereby the second transport means 12 exerts on recording medium 1 a predetermined nipping pressure sufficient to transport recording medium 1.

The first driving roller 3, the first driven roller 4 and second driving roller 5 are each supported by respective of non-illustrated bearings. Though one roller forming part of each roller pair of the second transport means 12 is not limited to the star wheels 6*a* to 6*e*, a contact area in which recording medium 1 is contacted by the second transport means 12 should be as small as possible in view of high likelihood that an image printed on recording medium 1 having passed through the printing position is still in an undried state.

In the second transport means 12, the star wheels 6*a* to 6*e* are vertically movably supported by spring members 8*a* and 8*b* so as to come into contact with or separate from the second driving roller 5 positioned therebelow while being biased toward the periphery of the second driving roller 5. Spring members 8*a* biasing the outermost star wheels 6*a* and 6*e* of the star wheels 6*a* to 6*e* forming the second transport means 12 at opposite ends in the primary scanning direction are each made to have a higher elastic force than each of spring members 8*b* biasing the other star wheels 6*b* to 6*d* and, hence, the nipping pressure of each of the opposite end star wheels 6*a* and 6*e* is higher than that of each of the other star wheel 6*b* to 6*d*. It should be noted that the nipping pressure exerted on recording medium 1 by the second transport means 12 is set sufficiently lower than that exerted on recording medium 1 by the first transport means 11.

The spring member 8 is supported on a frame via a non-illustrated support.

Recording medium 1 is transported in the direction indicated by arrow while being nipped between the first driving roller 3 and the first driven roller 4. Recording medium 1 is temporarily halted with a printing area thereof positioned just below the ink head 7 of the carriage unit 2. During the temporary halt of recording medium 1, the carriage unit 2 jets ink against recording medium 1 from the ink head 7 in accordance with image data to print an image while moving toward one side in the primary scanning direction. Upon arrival of the carriage unit 2 at one end in the primary scanning direction, the first driving roller 3 and the first driven roller 4 advance recording medium 1 until a succeeding printing area to be printed next comes into position and then stop advancing it. In this state the carriage unit 2 jets ink against recording medium 1 from the ink head 7 in accordance with image data to print an image while moving toward the other side in the primary scanning direction. This series of operations is repeated to print an image on the whole surface of recording medium 1.

If the leading edge of recording medium 1 is in a downwardly deformed state when it reaches the second transport means 12, recording medium 1 is first brought into contact with the second driving roller 5 at its leading edge and then transported as kept deformed downwardly as the second driving roller 5 rotates, thereby acting to press the star wheels 6*a* to 6*e* upwardly against the elastic force of the spring member 8.

However, such deformation frequently occurs at angular portions of recording medium 1. The star wheels 6*a* and 6*e* located at opposite ends for nipping angular portions on the leading edge side of recording medium 1 are biased by the spring member 8*a* toward the second driving roller 5 side with a stronger elastic force than the other star wheels 6*b* to 6*d* and, hence, will not easily be displaced upward by such deformed angular portions of recording medium 1. The elastic force of the spring member 8*a* is established so that the nipping pressure between the star wheel 6*a*, 6*e* and the second driving roller 5 becomes high enough to rectify such deformation at angular portions of recording medium 1. Accordingly, recording medium 1 is nipped between the second driving roller 5 and the star wheels 6*a* to 6*e* with its deformed angular portions rectified. In this way recording medium 1 can be transported in an ideal condition.

The nipping pressure between each of the star wheels 6*a* to 6*e* and the associated second driving roller 5, which determines the elastic force of each of the spring members 8*a* and 8*b*, is influenced by various factors including the distance from an adjacent one of the star wheels 6*a* to 6*e*, the nipping pressure of the adjacent one of the star wheels 6*a* to 6*e*, the distance from the first transport means 11, the height at which each of the star wheels 6*a* to 6*e* and the associated second driving roller 5 contact each other, and the thickness and quality of recording medium 1 to be transported. Therefore, the elastic force of each of the spring members 8*a* and 8*b* is experimentally established in view of these factors.

The nipping pressure between each of the star wheels 6*a* to 6*e* and the associated second driving roller 5 can be varied not only by varying the elastic force of the spring members 8*a* and 8*b* but also by changing the mounting method for or the mounted form of spring members 8 of a single type or the like. Thus, the operation of mounting the spring members 8 can be facilitated. Alternatively, it is possible to vary the nipping pressure between each of the star wheels 6*a* to 6*e* and the second driving roller 5 by varying the weight of each of the star wheels 6*a* to 6*e*.

Figure 4A:
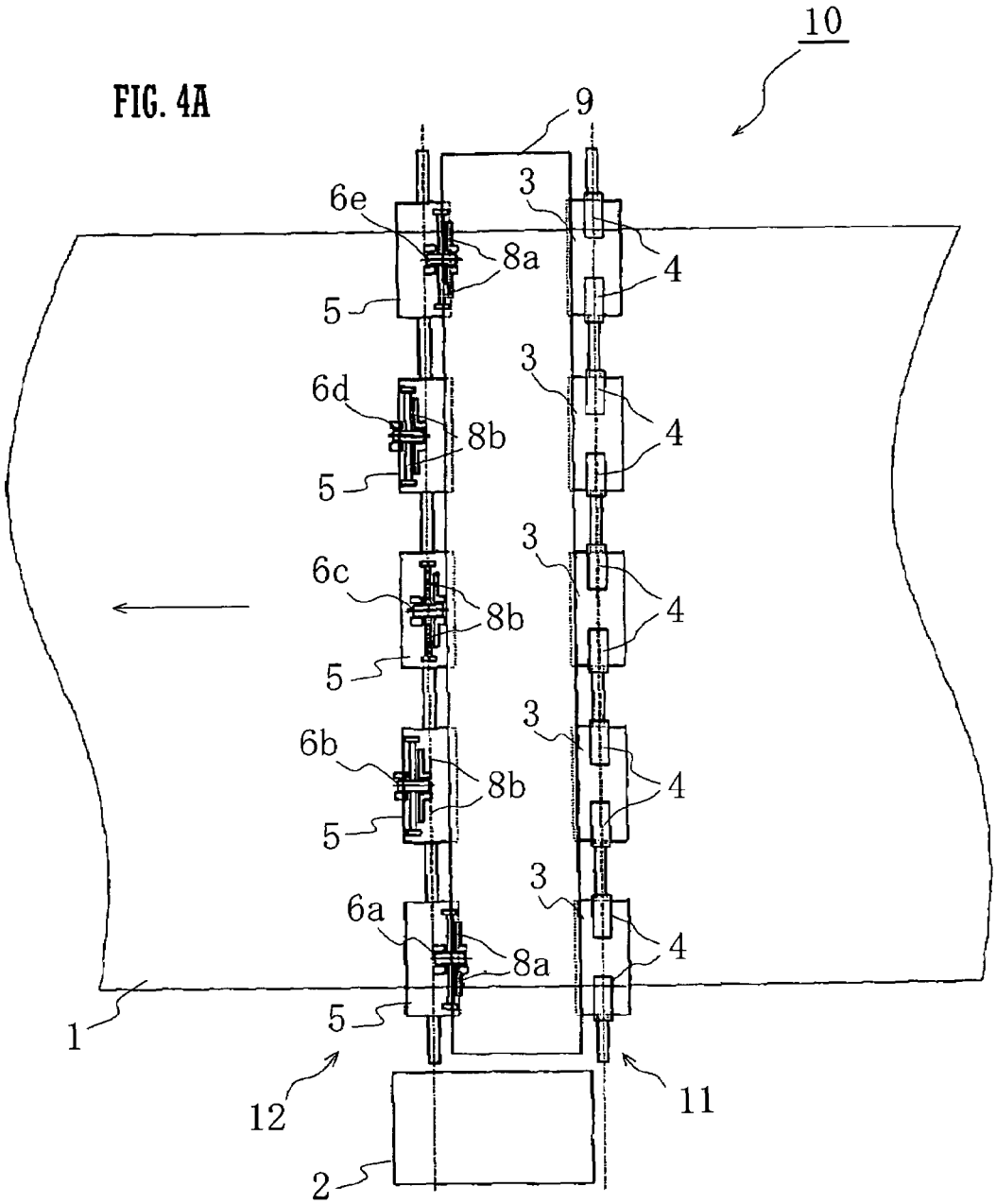
FIGS. 4A and 4B are a plan view and a side elevational view, respectively, showing a portion of concern of an ink jet printer as one example of recording apparatus according to another embodiment of the present invention.
Figure 4B:
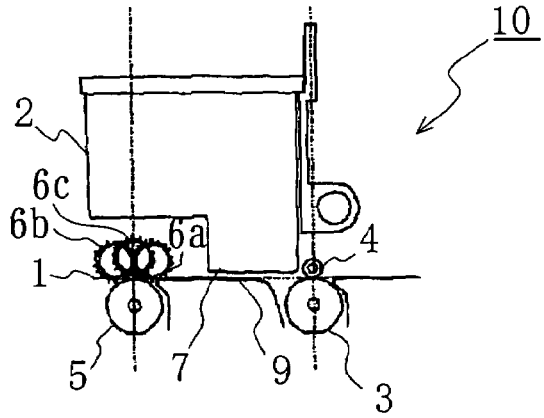

FIGS. 4A and 4B are a plan view and a side elevational view, respectively, showing a portion of concern of an ink jet printer as one example of recording apparatus according to another embodiment of the present invention. In ink jet printer 10 of this embodiment, the second transport means 12 includes opposite end star wheels 6*a* and 6*e*, central star wheel 6*c* and intermediate star wheels 6*b* and 6*d*, which are arranged in this order from upstream to downstream in the recording medium 1 transport direction. Thus, the star wheels 6*a* to 6*b* are arranged at plural positions in the recording medium 1 transport direction so that the nipping position of each of the opposite end star wheels 6*a* and 6*e* having a relatively high nipping pressure fails to coincide with that of any one of the other star wheels 6*b* to 6*d*.

With this arrangement, the relatively high nipping pressure of the opposite end star wheels 6*a* and 6*e* is not exerted on the leading edge portion of recording medium 1 at the same time with the nipping pressure of the other star wheels 6*b* to 6*d*. Thus, there is no possibility that large load fluctuations occur during passage of recording medium 1 through the second transport means 12. For this reason, this arrangement can assuredly rectify deformation at the angular portions of the recording medium 1 without any impediment to smooth transport of recording medium 1.

Further, since the plural second driving rollers 5 of the second transport means 12 are secured to a single rotating shaft, the star wheels 6*a* to 6*e* are positioned along the circumference of the second driving roller 5 as shown in FIG. 4B by establishing the plural nipping positions between the second driving rollers 5 and the star wheels 6*a* to 6*e* in the recording medium 1 transport direction. Thus, recording medium 1 can be transported in a more ideal condition.

In order to reduce load fluctuations at the leading edge portion of recording medium 1 being transported, the nipping position of the central star wheel 6*c* made to exert a lower nipping pressure than the opposite end star wheels 6*a* and 6*c* may conceivably be located most upstream in the recording medium transport direction. By so doing, the leading edge portion of recording medium 1 reaching the second transport means 12 is first applied with a relatively low nipping pressure at a central portion thereof which is subject to large deformation. In this case, the central star wheel 6*c*, intermediate star wheels 6*b* and 6*d*, and opposite end star wheels 6*a* and 6*e* are arranged in this order from upstream to downstream in the recording medium transport direction.

In the case where the second transport means 12 has three or more nipping positions in the recording medium 1 transport direction, three or more nipping pressures may be established, provided that the opposite end star wheels 6*a* and 6*e* have the highest nipping pressure. This arrangement is capable of rectifying deformation at the leading edge portion of recording medium 1 more finely. In this case, if the central star wheel 6C and the opposite end star wheels 6*a* and 6*e* are located most upstream and most downstream, respectively, in the recording medium 1 transport direction, the leading edge portion of recording medium 1 being transported is applied with gradually increasing nipping pressure with no possibility of abruptly receiving a high nipping pressure, whereby recording medium 1 can be transported more smoothly.

Further, if the recording medium 1 transport speed of the second transport means 12 is set higher than that of the first transport means 11, there is no possibility that recording medium 1 becomes deflected at the printing position between the first transport means 11 and the second transport means 12 and, hence, it is possible to keep recording medium 1 in a favorable flat condition on the platen 9 thereby to keep the image printing condition satisfactory. Also, tension working in the transport direction is exerted on recording medium 1 being transported, so that deformation of recording medium 1 can be rectified more effectively.

Figure 5A:
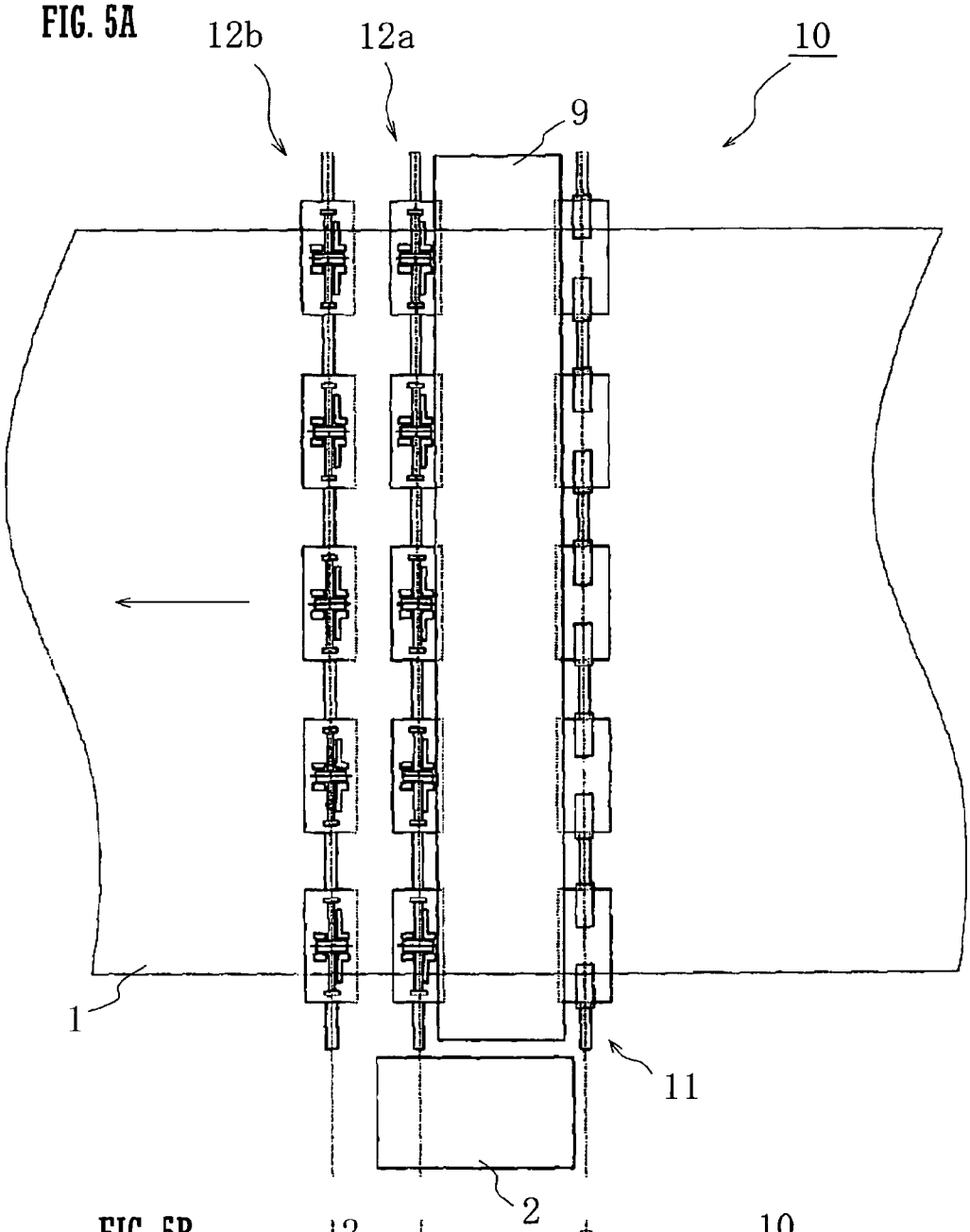
FIGS. 5A and 5B are a plan view and a side elevational view, respectively, showing a portion of concern of an ink jet printer as one example of recording apparatus according to yet another embodiment of the present invention.
Figure 5B:
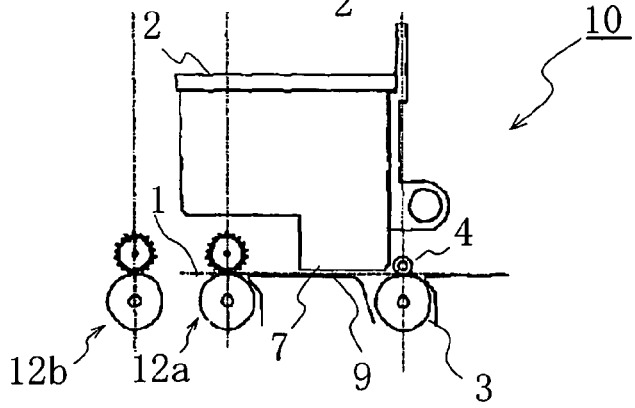

FIGS. 5A and 5B are a plan view and a side elevational view, respectively, showing a portion of concern of an ink jet printer as one example of recording apparatus according to yet another embodiment of the present invention. In ink jet printer 10 of this embodiment, a plurality of second transport means 12*a* and 12*b* are arranged in the recording medium 1 transport direction.

This arrangement is capable of nipping recording medium 1 at two points in the transport direction during a period after passage of the trailing edge of recording medium 1 through the first transport means 11 until arrival of the trailing edge at the second transport means 12. Accordingly, even if deformation occurs at angular portions of recording medium 1 on the trailing edge side, this arrangement can reliably rectify such deformation by means of the second driving rollers 5 and the star wheels 6*a* to 6*e* disposed at opposite ends in the direction perpendicular to the transport direction while keeping the surface of recording medium 1 parallel with the transport direction. Thus, it is possible to continue smooth transport until the trailing edge of recording medium 1 passes through the second transport medium 12.

It should be noted that the present invention is applicable not only to ink jet printers of the type configured to realize printing by jetting ink but also to various types of recording apparatus. Accordingly, if there is no need to take into consideration a dry degree of an image on recording medium 1 having passed through the printing position, each of the roller pairs of the second transport means 12 does not necessarily need to comprise star wheel but may comprise a cylindrical roller instead.

Also, the plural roller pairs need not necessarily be disposed symmetrically with respect to the center position in direction perpendicular to the recording medium transport direction.

As has been described above, the present invention makes it possible to transport a recording medium 1 ideally regardless of the shape of leading edge of the recording medium 1 as well as to minimize damage to the recording medium 1. Though other methods of ideally transporting the recording medium 1 regardless of the shape of leading edge of the recording medium 1 are conceivable, the arrangement of the present invention makes it possible to realize such ideal transport with a lower parts count as well as to increase and decrease the pressure with the same form of structure. Thus, the present invention is also advantageous in terms of cost and allows the design of apparatus to be simplified.

The invention claimed is:

1. A recording apparatus wherein: a recording medium is transported by first and second transport means nipping the recording medium; and the second transport means comprises plural roller pairs arranged in a direction perpendicular to a recording medium transport direction and is disposed downstream of the first transport means in the recording medium transport direction, characterized in that each of the roller pairs of the second transport means is set to have a lower nipping pressure than the first transport means, while an outermost one of the roller pairs set to have a higher nipping pressure than the rest of the roller pairs.

2. The recording apparatus according to claim 1, wherein the plural roller pairs of the second transport means are disposed to have plural nipping positions in the recording medium transport direction such that the outermost one of the plural roller pairs is different in nipping position from the rest of the plural roller pairs.

3. The recording apparatus according to claim 1, wherein the plural roller pairs of the second transport means are disposed to have plural nipping positions in the recording medium transport direction such that a central one of the plural roller pairs has a nipping position located most upstream.

4. The recording apparatus according to claim 1, wherein the plural roller pairs of the second transport means are disposed to have plural nipping positions in the recording medium transport direction such that any one of the roller which is located immediately downstream of an upstream one of the roller pairs has a higher nipping pressure than the upstream one.

5. The recording apparatus according to claim 1, wherein the second transport means is configured to transport the recording medium at a higher speed than the first transport means.

6. The recording apparatus according to claim 1, wherein a plurality of such second transport means are arranged in the recording medium transport direction.

7. The recording apparatus according to claim 1, wherein each of the roller pairs forming the second transport means comprises a driving roller receiving a rotational force transmitted thereto, and a star wheel driven to rotate by the driving roller rotating.

8. The recording apparatus according to claim 1, wherein a carriage unit having an ink head configured to jet ink against the recording medium is disposed between the first and second transport means arranged in the recording medium transport direction to reciprocate in the direction perpendicular to the recording medium transport direction.

* * * * *